US006957764B2

(12) United States Patent
Pozzoli

(10) Patent No.: US 6,957,764 B2
(45) Date of Patent: Oct. 25, 2005

(54) ARTICLE FOR FORMING A BOX-LIKE BODY, PARTICULARLY FOR STORAGE OF MEDIA CONTAINERS

(75) Inventor: Aldo Pozzoli, Inzago (IT)

(73) Assignee: Pozzoli S.p.A., Inzago (IT)

( * ) Notice: Subject to any disclaimer, the term of this patent is extended or adjusted under 35 U.S.C. 154(b) by 89 days.

(21) Appl. No.: 10/759,048

(22) Filed: Jan. 20, 2004

(65) Prior Publication Data

US 2004/0144836 A1 Jul. 29, 2004

(30) Foreign Application Priority Data

Jan. 29, 2003 (IT) ..... MI2003A0144

(51) Int. Cl.[7] ..... B65D 5/06
(52) U.S. Cl. ..... 229/136; 229/132; 229/900
(58) Field of Search ..... 229/80, 132, 136, 229/900; 53/376.4, 491; 493/141, 183

(56) References Cited

U.S. PATENT DOCUMENTS 2,496,336 A 2/1950 Cupo
2,962,205 A * 11/1960 McFarland ..... 229/80
2,998,180 A 8/1961 Dehoney, Jr.
3,130,895 A 4/1964 Davis
3,301,462 A 1/1967 Starr
3,306,521 A 2/1967 Giacovas
RE26,742 E * 12/1969 Laskow ..... 229/132
5,002,220 A * 3/1991 Safranski ..... 229/80
5,465,900 A * 11/1995 Baratto et al. ..... 229/125.39
5,722,585 A * 3/1998 Redl ..... 229/136
6,059,178 A 5/2000 Malloy et al.
6,070,790 A 6/2000 Anderson
2001/0022319 A1 * 9/2001 Chevalier ..... 229/136

* cited by examiner

*Primary Examiner*—Gary E. Elkins
(74) *Attorney, Agent, or Firm*—Guido Modiano; Albert Josif; Daniel O'Byrne

(57) ABSTRACT

An article for forming a box-like body, particularly for storage of media containers, comprising a sheet-like element that is folded so as to form a tubular body that can be flattened and forms two larger faces joined by an upper minor face and a lower minor face; an inner flap and an outer flap are provided respectively on one of the free edges of each one of the larger faces, and the flaps can be mutually overlapped in order to form the box-like body, the article further comprising, on the inner flap, a layer of self-adhesive material protected by a removable protective layer, means being further provided for removing the protective layer by way of automatic devices.

7 Claims, 4 Drawing Sheets

ARTICLE FOR FORMING A BOX-LIKE BODY, PARTICULARLY FOR STORAGE OF MEDIA CONTAINERS

BACKGROUND OF THE INVENTION

The present invention relates to a manufactured article for forming a box-like body, particularly for storage of media containers.

As is known, media such as DVDs, CDs, magnetic tapes and the like are currently usually stored in containers which are in turn inserted in a sleeve formed by means of a box-like body which, if made of paper-like material such as printed cardboard or the like, is substantially shaped like a parallelepiped with an open face for the insertion of the media container in a book-like fashion.

In quality products, such as DVDs and the like, the containers are preferably made of cardboards that are printed, possibly in relief, and are shaped so that the edges do not bear creasing or die-cutting lines.

In order to solve this problem, sheet-like elements are currently produced which are folded so as to form a tubular body that can be flattened and defines the two larger faces, which are joined by an upper minor face and a lower minor face; one of said minor faces is open, and on the opposite face there is a flap that can be closed detachably in a box-like fashion.

This kind of solution, albeit widely used, has the drawback that it does not ensure optimum closure of the back of the box-like body, since there is a certain inevitable splaying or "bellying" of the larger face next to which the closure flap, which is not retained, is inserted.

In order to solve this problem, it would be necessary to perform pasting at the rear minor face, but this solution can be provided easily only by the paper product industry that manufactures the sleeve; however, in this case it would then be necessary to transport the container in the already-formed condition, with an evident space occupation, therefore handling very bulky masses but a limited number of containers, due to the fact that the formed box-like element is empty.

In order to try to solve this problem, box-like bodies or sleeves or holders have already been devised which have, on one of the flaps that must be closed to form the back, a layer of self-adhesive paste protected by a removable protective layer, so that it is possible to transport the sleeves or holders in a flattened configuration and allow them to be formed by those that insert the media containers, such as DVD containers and the like, that have been prepared by the publisher.

However, this solution entails the need to form the sleeve or holder manually, and obviously this solution is not feasible if it is necessary to provide a large number of sleeves, since the associated costs would be particularly high.

SUMMARY OF THE INVENTION

The aim of the invention is to solve the problem described above, by providing an article for forming a box-like body, particularly for storage of media containers, which allows to automate the step of forming the box-like body without entailing the step of applying pastes, allowing instead to use a ready-made self-adhesive layer, which accordingly allows even an industry that is not in the paper product sector to perform the final formation of the sleeve.

Within this aim, an object of the invention is to provide an article in which it is possible to transport the sleeves or box-like bodies in a flattened position, performing the formation process by using automatic machines.

Another object of the present invention is to provide an article in which the particular technical solutions used allow to automate the formation steps by using mechanical means that are particularly simple and effective.

Another object of the present invention is to provide an article that thanks to its particular constructive characteristics is capable of giving the greatest assurances of reliability and safety in use.

Another object of the present invention is to provide an article that can be obtained easily starting from commonly commercially available elements and materials and is further competitive from a merely economical standpoint.

This aim and these and other objects that will become better apparent hereinafter are achieved by an article for forming a box-like body, particularly for storage of media containers, according to the invention, which comprises a sheet-like element that is folded so as to form a tubular body that can be flattened and forms two larger faces joined by an upper minor face and a lower minor face, an inner flap and an outer flap being provided respectively on one of the free edges of each one of said larger faces, said flaps being mutually overlappable in order to form the box-like body, characterized in that it comprises, on said inner flap, a layer of self-adhesive material protected by a removable protective layer, means being further provided for removing said protective layer by means of automatic devices.

BRIEF DESCRIPTION OF THE DRAWINGS

Further characteristics and advantages will become better apparent from the description of a preferred but not exclusive embodiment of an article for forming a box-like body for storing media containers in particular, illustrated by way of non-limitative example in the accompanying drawings, wherein.

DESCRIPTION OF THE PREFERRED EMBODIMENTS

Figure 1:
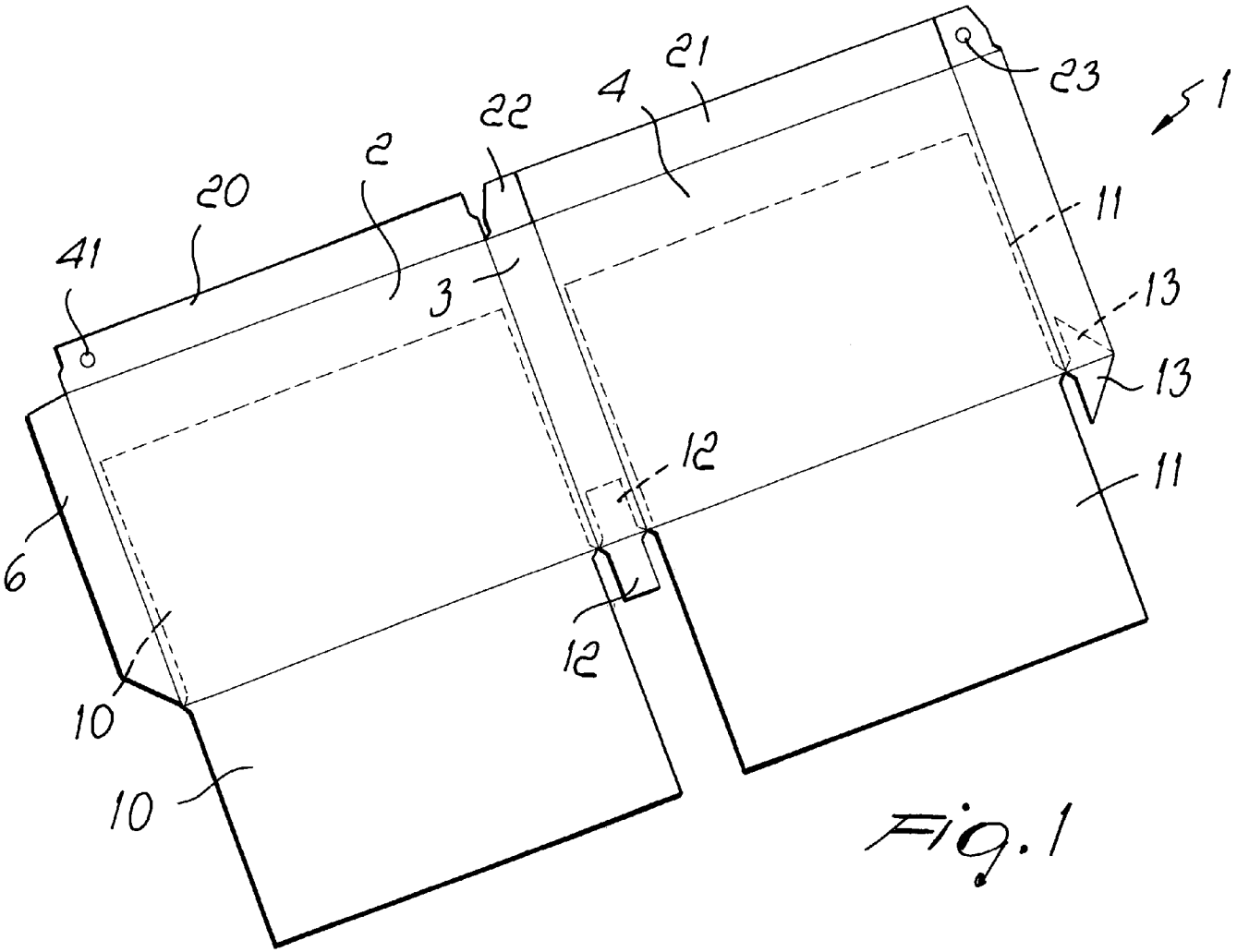
FIG. 1 is a schematic view of the sheet-like element that constitutes the article, illustrating in dashed lines the folded position of the finishing wings.
Figure 2:
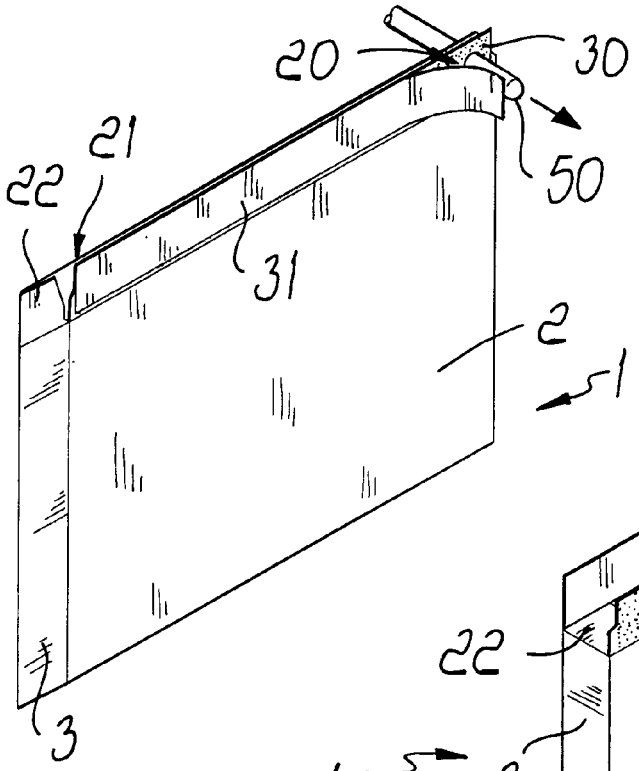
FIG. 2 is a view of the tubular body in the flattened position, obtained by folding the sheet-like element, illustrating the means for removing the removable protective layer.
Figure 3:
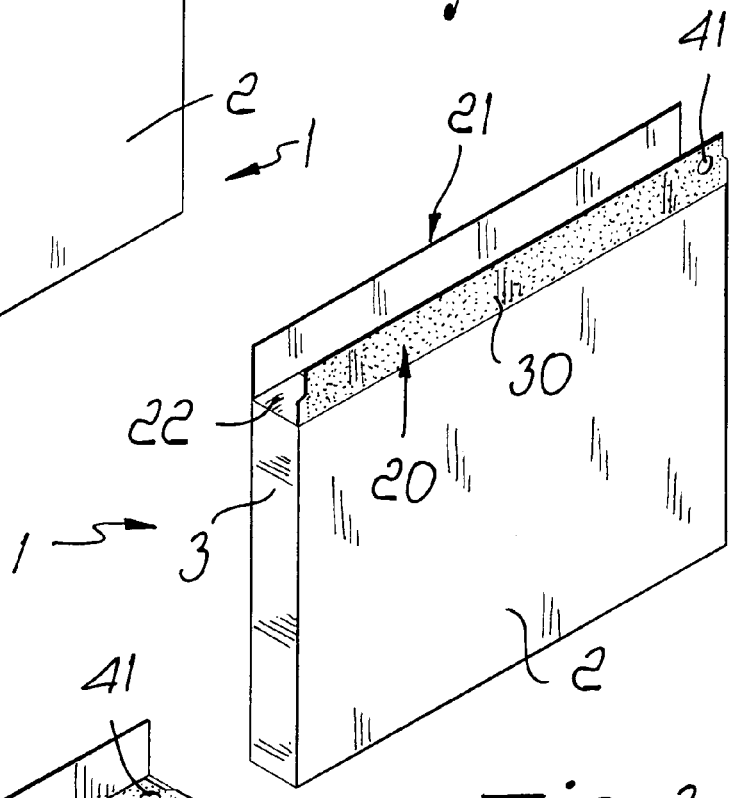
FIG. 3 is a view of the box-like body after removing the protective layer.

With reference to the figures, the article for forming a box-like body, particularly for storage of media containers, according to the invention, comprises a sheet-like element, generally designated by the reference numeral 1, which is preferably but not necessarily made of paper-like material with print, possibly in relief, on its outer face.

The sheet-like element 1 forms a front larger face 2, which is joined by means of an upper minor face 3 to a rear larger face 4, which is connected to a first flap of the lower minor face 5 that can be pasted over a second flap 6 of the lower minor face that is connected at the free edge of the front larger face 2.

In order to obtain an optimum finish without leaving exposed die-cut edges, a front wing 10 is connected to the front larger face by way of a folding line and can be folded onto the front larger face 2, as shown in dashed lines; likewise, there is a rear wing 11, which is connected to the rear larger face 4, and an upper wing 12 is connected to the edge of the upper minor face; there is also a triangular lower wing 13, which is inserted at a corresponding bevel formed by the second flap 6.

Once the finishing wings 10, 11, 12 and 13 have been folded and the first flap and the second flap of the lower minor face have been mutually pasted, a tubular body that can be flattened is formed, providing the box-like body.

An inner flap 20 and an outer flap 21 are provided at the free edges of the larger faces, i.e., at the edges that are not affected by the wings 10 and 11; the inner flap 20 is connected to the front face 2 and the outer flap 21 is connected to the rear larger face 4.

There is also an upper tab 22, which is connected to the upper minor face 3, and a lower tab 23, which is connected at the first flap of the lower minor face 5.

On the outer face of the inner flap 20 there is a layer of self-adhesive material 30, which is protected by a removable protective layer 31, which is constituted for example by the typical sheet with polythene-coated surface that allows easy separation from the self-adhesive material.

The particular feature of the invention is constituted by the fact that means are provided which allow to remove the protective layer by means of automatic machines.

Said means, in a preferred embodiment, are provided by a first through hole 40, which is provided on the lower tab 23, and by a second through hole 41, which is formed at one end of the inner flap 20 provided with the self-adhesive layer.

The holes 40 and 41 are aligned one another when the box-like body is in the flattened position; possibly, the first through hole may be made by way of a shaped recess or cavity which, with the box-like body in a flattened position, is in collimation with a second hole that has a corresponding conformation.

Figure 4:
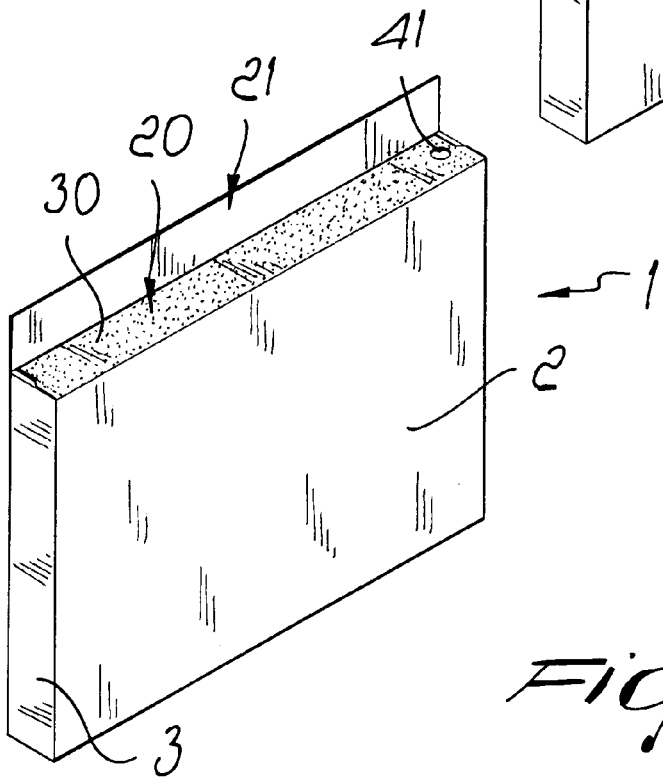
FIG. 4 is a view of the step for folding the inner flap with the self-adhesive layer.
Figure 5:
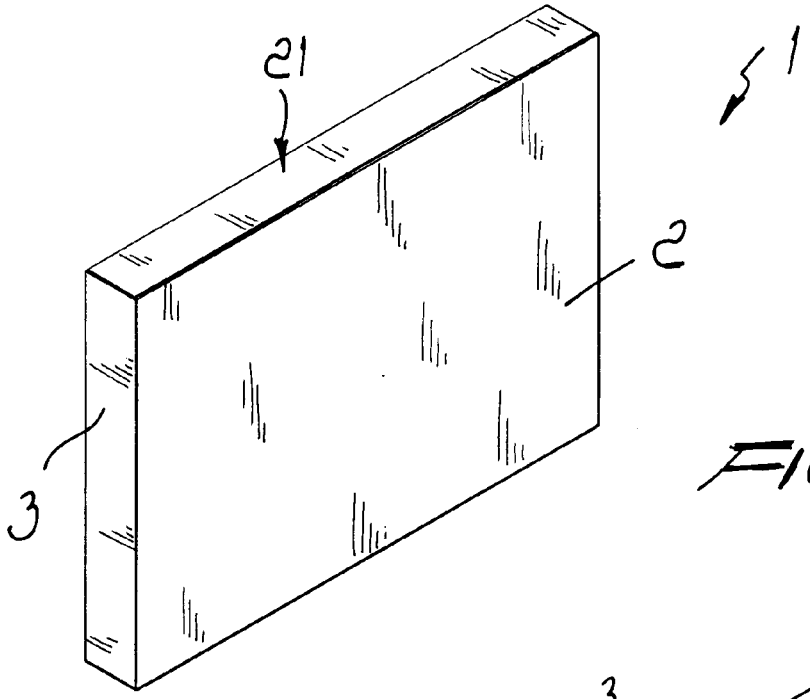
FIG. 5 is a view of the final step for folding and pasting the outer flap.
Figure 6:
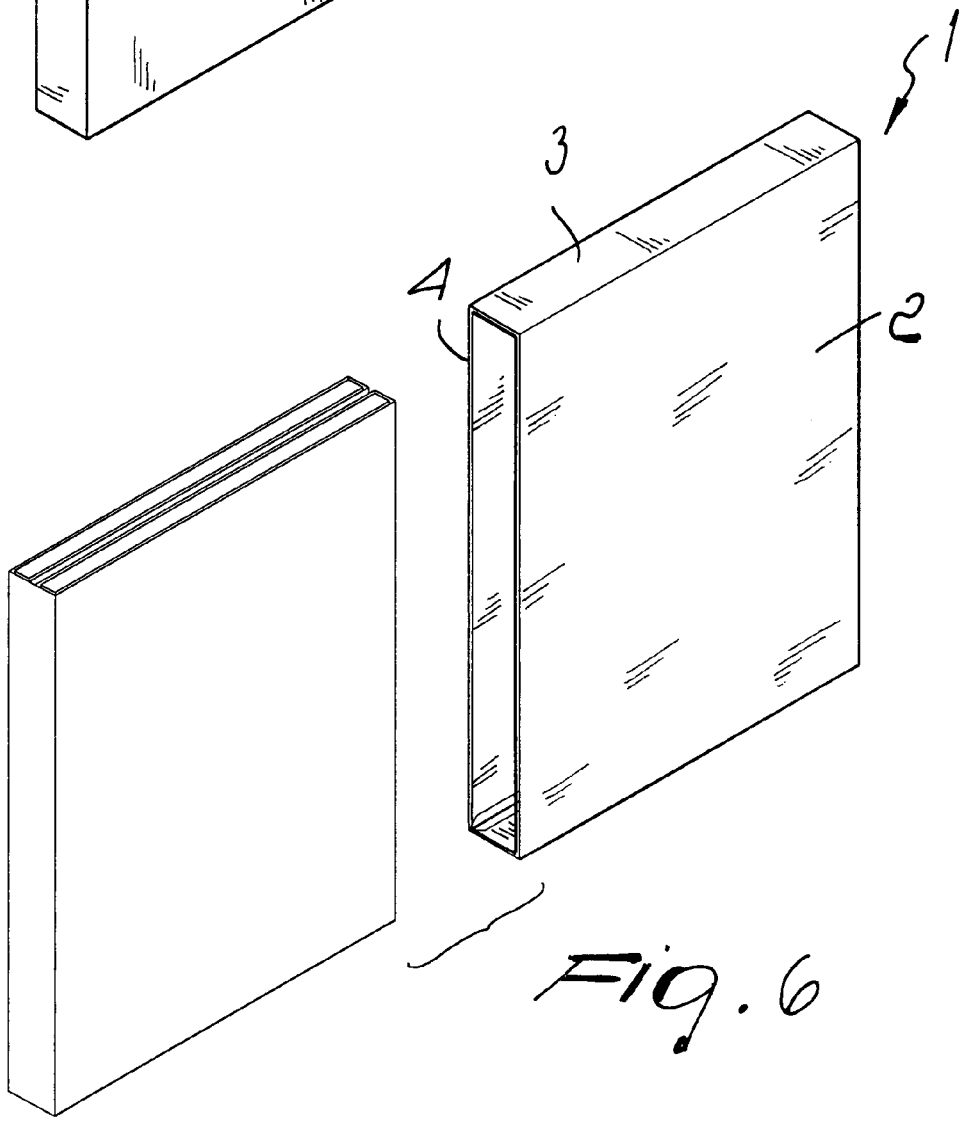
FIG. 6 is a schematic exploded view of the box-like body and of the container of media such as DVDs.
Figure 7:
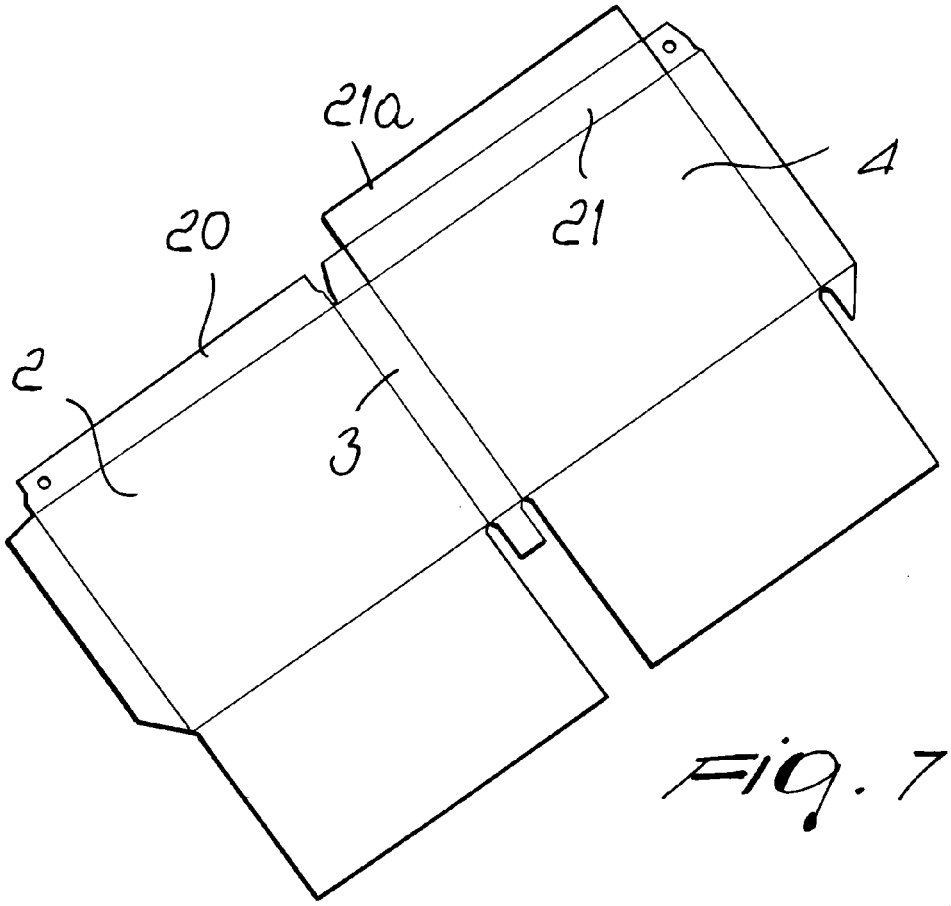
FIG. 7 is a schematic view of the sheet-like element in a form that covers to the view the edge of the outer flap.
Figure 8:
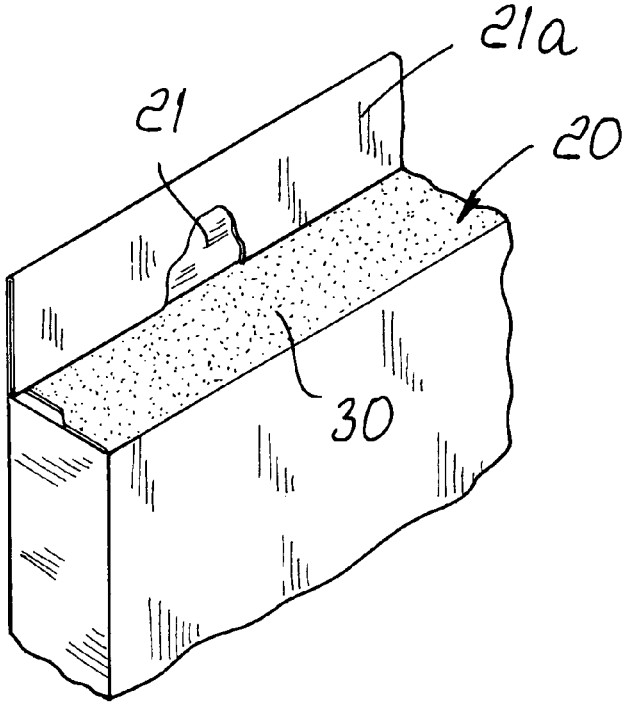
FIG. 8 shows the outer flap with the sheet-like element of FIG. 7, before its overlapping on the inner flap.

In order to remove automatically the self-adhesive layer, there is a punch 50, which is inserted in the aligned holes 40 and 41 so as to separate one end or flap of the removable protective layer 31, which can be gripped easily by a removal element, which separates it automatically from the self-adhesive layer, which can thus be folded, as shown in FIG. 4, and on which it is possible to fold, in turn, the outer flap 21, forming the box-like body.

It is thus evident that a solution is provided which allows even the non-paper product industry, which as such is not equipped with machines capable of performing pasting operations, to perform automatically the formation of the box with pasting of the minor faces, which is currently done manually or can be performed only in the paper product industry.

The particularity of the invention therefore consists in that it provides means that are also particularly simple, since they are substantially obtained by the presence of the two holes 40 and 41, which arrange themselves in mutual alignment with the tubular body in a flattened position and allow the automatic insertion of an extractor, with the possibility to pick up automatically the self-adhesive protective layer, facilitating its removal and thus allowing the rapid formation of the box.

The invention thus conceived is susceptible of numerous modifications and variations, all of which are within the scope of the appended claims.

All the details may further be replaced with other technically equivalent elements. Thus, for example, in order to reduce to a minimum the die-cut or creased edges that remain in view, it is possible to provide an additional flap 21*a*, alongside said outer flap 21, that is foldable on said outer flap 21, whereby a folding or creasing line and not a cut edge remains in view.

In practice, the materials used, as well as the contingent dimensions and shapes, may be any according to requirements.

The disclosures in Italian Patent Application No. MI2003A000144 from which this application claims priority are incorporated herein by reference.

What is claimed is:

1. An article for forming a box-like body, for storage of media containers, comprising a sheet element that is folded so as to form a tubular body that can be flattened and forms two larger faces joined by an upper minor face and a lower minor face, an inner flap and an outer flap being provided respectively on one of the free edges of each one of said larger faces, said flaps being mutually overlappable in order to form the box-like body, wherein, a layer of self-adhesive material protected by a removable protective layer is provided on said inner flap, and removal means being further provided for removing said protective layer by way of automatic devices.

2. The article of claim 1, wherein said removable protective layer is constituted by a sheet with a polythene-coated surface.

3. The article of claim 1, wherein said sheet element comprises an upper tab connected to said upper minor face and a lower tab connected at said lower minor face, said upper and lower tabs being foldable below said inner and outer flaps when the box is formed.

4. The article of claim 1, wherein said removal means for removing said protective layer by way of automatic devices comprise at least one through hole, which is formed at one end of said inner flap provided with said self-adhesive layer, for insertion of a punch for separating a flap of said protective layer.

5. The article of claim 1, wherein said means for removing said protective layer by way of automatic devices comprise a first through hole, which is formed on said lower tab, and a second through hole, which is formed at the ends of said inner flap, said holes being arrangeable in mutual alignment when said box-like body is in a flattened position.

6. The article of claim 1, wherein in said box-like body, a face that lies opposite the one formed by said mutually overlapping inner and outer flaps is open, free edges of said larger faces at said open face being formed by folding of a front wing and of a rear wing, which are respectively connected to the front larger face and to the rear larger face of said sheet element.

7. The article of claim 6, comprising an additional flap, arranged alongside said outer flap, which is foldable on said outer flap so as to define a creasing or folding line on the free longitudinal edge of said outer flap.

* * * * *